US005355049A

United States Patent [19]

Sung

[11] Patent Number: 5,355,049

[45] Date of Patent: Oct. 11, 1994

[54] ASSEMBLY OF SHADOW MASK FRAME WITH INNER SHIELD FOR COLOR CATHODE RAY TUBE

[75] Inventor: Sitaek Sung, Kyunggi, Rep. of Korea

[73] Assignee: Samsung Electron Devices Co., Ltd., Kyunggi, Rep. of Korea

[21] Appl. No.: 7,548

[22] Filed: Jan. 22, 1993

[30] Foreign Application Priority Data

Mar. 3, 1992 [KR] Rep. of Korea ..... 92-3496

[51] Int. Cl.[5] ..... H01J 29/06

[52] U.S. Cl. ..... 313/402; 313/407

[58] Field of Search ..... 313/402, 407, 313; 315/85

[56] References Cited

U.S. PATENT DOCUMENTS

| | | | |
|---|---|---|---|
| 2,890,362 | 6/1959 | Francken | 313/85 |
| 2,898,494 | 8/1959 | Haas | 313/84 |
| 2,986,667 | 5/1961 | Tirico | 313/76 |
| 3,243,645 | 3/1966 | Parnes et al. | 315/15 |
| 3,431,454 | 3/1969 | Sanders | 315/8 |
| 3,571,652 | 3/1971 | Shiobara | 315/8 |
| 3,614,519 | 10/1971 | Figlewicz | 315/8 |
| 3,737,703 | 6/1973 | Tsuneta et al. | 313/85 |
| 3,808,493 | 4/1974 | Kawamura et al. | 313/85 |
| 3,822,453 | 7/1974 | Shrader | 313/85 |
| 4,019,085 | 4/1977 | Sakata | 313/402 |
| 4,070,596 | 1/1978 | Tsuneta et al. | 313/408 |
| 4,229,675 | 10/1980 | Matsuki et al. | 313/402 |
| 4,857,795 | 8/1989 | Wakita et al. | 313/402 |
| 5,126,624 | 6/1992 | Ji | 313/402 |

FOREIGN PATENT DOCUMENTS

| | | |
|---|---|---|
| 959911 | 12/1974 | Canada . |
| 2050841 | 10/1970 | Fed. Rep. of Germany . |
| 52-18165 | 2/1977 | Japan . |
| 53-16575 | 2/1978 | Japan . |
| 54-13253 | 1/1979 | Japan . |
| 55-36928 | 8/1980 | Japan . |
| 1456430 | 11/1976 | United Kingdom . |
| 2000902 | 1/1979 | United Kingdom . |

OTHER PUBLICATIONS

"Design Principles of the RCA Large-Screen 110° Precision In-Line Color Picture Tube"; A. M. Morrell; IEEE Transactions on Consumer Electronics, Feb. 1976.

*Primary Examiner*—Sandra L. O'Shea
*Attorney, Agent, or Firm*—Christie, Parker & Hale

[57] ABSTRACT

The present invention provides the assembly of a shadow mask frame with an inner shield for a color cathode ray tube having a shadow mask frame, an inner shield and a clip for coupling the shadow mask frame with the inner shield, the frame having a rim part and a flange part bent at a nearly right angle to the rim part and extending inwardly, wherein: a sloping face is formed to a predetermined width between the rim part and the flange part of the frame with a predetermined obtuse angle therebetween, and the inner shield includes a fixing part aligned with the sloping face and having the same width as that of the sloping face, a flat part bent at the same angle as the angle between the sloping face and the flange part, and a shield part extending to a predetermined length from the inside edge of the flat part and bent at a predetermined angle with respect to the flange part of the frame, and each slot is formed on the positions of the sloping face of the frame and the fixing part of the inner shield corresponding to each other when the sloping face is aligned with the fixing part, and the clip is inserted into the slots to couple the frame with the inner shield.

4 Claims, 2 Drawing Sheets

ASSEMBLY OF SHADOW MASK FRAME WITH INNER SHIELD FOR COLOR CATHODE RAY TUBE

BACKGROUND OF THE INVENTION (1) Field of the Invention

The present invention relates to a color picture tube of shadow mask type and, more specially to an assembly of a shadow mask frame with an inner shield for a more improved color cathode ray tube to easily couple the shadow mask frame with the inner shield.

(2) Description of the Related Art

FIG. 3 schematically depicts the internal structure of a face panel for a color picture tube of a general shadow mask type. A shadow mask frame 2 is disposed therein by an appropriate tool. A shadow mask 6 having a plurality of apertures through which electron beams pass are formed facing the face panel of the frame 2. Also, an inner shield 8 for shielding the influence of geomagnetic field over the electron beams injected from electron guns is fixed distant from the face panel of the frame 2 by a clip 10.

The way to couple the conventional frame 2 with the inner shield 8 is in detail described in FIG. 4.

The frame 2 has a rim part 12 and a flange part 14 which is bent nearly perpendicular to the rim part 12 and extended to the inside of the frame itself. The inner shield 8 has a fixing part 24 superposed on a flange part 14 of the frame and a shielding part 16 extending in an acute angle bent from the outer edge of the fixing part 24. The terms, "inner" and "outer" (edges) indicates the direction relative to the center of the frame.

The assembly of the frame 2 with the inner shield 8 is performed by the known clip 10. When superposing the flange part 14 of the shadow mask frame 2 on the fixing part 24 of the inner shield 8, a plurality of slots 18, 20 of the same shape which the clip 10 is inserted into are formed at a position where the flange part 14 is aligned with the fixing part 24 with each other.

In the assembling process, after adjusting the relative position of the frame 2 and the inner shield 8, so that slots 18, 20 of these members agree to each other, the clip 10 is then inserted into the slots 18, 20.

However, the free end of the fixing part 24 of the inner shield 8 and that of the flange part 14 of the frame 2 are extended in the same direction with each other. The working space in the vicinity of the slots 18, 20 is too small to insert the clip 10 thereto.

If the free end of the fixing part 24 of the inner shield 8 is extended to the direction opposite to the free end of the flange part of the frame 2, the working space in the vicinity of the slots 18, 20 may be enlarged. However, while this case can be generally applied to a color cathode ray tube of less than 16 inches, it can not be applied to the comparative large color cathode ray tube of more than 19 inches.

To solve this problem, a relatively large opening 22 is formed in the vicinity of the slots 20 of the inner shield 8.

In the assembling process of the frame 2 with the inner shield 8, the opening 22 serves a passage for insertion of the clip into the slots 18, 20.

If the opening is formed in the shield part 16, the shielding effect of the geomagnetic field obtained from the shield part 16 is reduced. Further, the inner shield is made of a thin steal sheet to a thickness of about 0.2 mm. The inner periphery edge of the opening 22 is so sharp as to do an injury to a worker.

U.S. Pat. No. 3,737,703 granted to Tokyo Shibaura electronic company of Japan discloses an invention entitled "Shadow mask frame structure" where the bending angle between the rim and the flange is formed with an obtuse angle.

However, an object of the above prior art technology is not to easily couple the frame with the inner shield but to prevent the torsional deformation of the frame appeared in the high temperature treatment during the forming process of the frame. This structure cannot overcome the difficulty in the assembling process of the frame with the inner shield.

SUMMARY OF THE INVENTION

An object of the present invention is to provide an assembly of a shadow mask frame with an inner shield for the improved color cathode ray tube to easily couple the shadow mask frame with the inner shield.

In order to obtain this object, the present invention provides the assembly of a shadow mask frame with an inner shield for a color cathode ray tube having a shadow mask frame, an inner shield and a clip for coupling the shadow mask frame with the inner shield, the frame having a rim part and a flange part bent at a nearly right angle to the rim part and extending inwardly, wherein: a sloping face is formed to a predetermined width between the rim part and the flange part of the frame with a predetermined obtuse angle therebetween, and the inner shield includes a fixing part aligned with the sloping face and having the same width as that of the sloping face, a flat part bent at the same angle as the angle between the sloping face and the flange part, and a shield part extending to a predetermined length from the inside edge of the flat part and bent at a predetermined angle with respect to the flange part of the frame, and each slot is formed on the positions of the sloping face of the frame and the fixing part of the inner shield corresponding to each other when the sloping face is aligned with the fixing part, and the clip is inserted into the slots to couple the frame with the inner shield.

BRIEF DESCRIPTION OF THE DRAWINGS

This invention can be more fully understood from the following detailed description when taken in conjunction with the accompanying drawings, wherein.

DETAILED DESCRIPTION OF THE PREFERRED EMBODIMENTS

Figure 1:
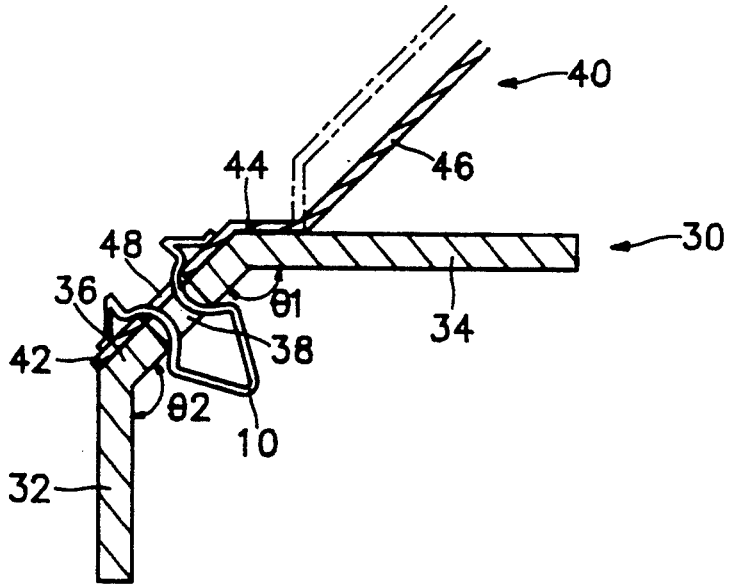
FIG. 1 depicts a schematic view showing a partial section of an assembly in accordance with a first preferred embodiment of this invention.
Figure 2:
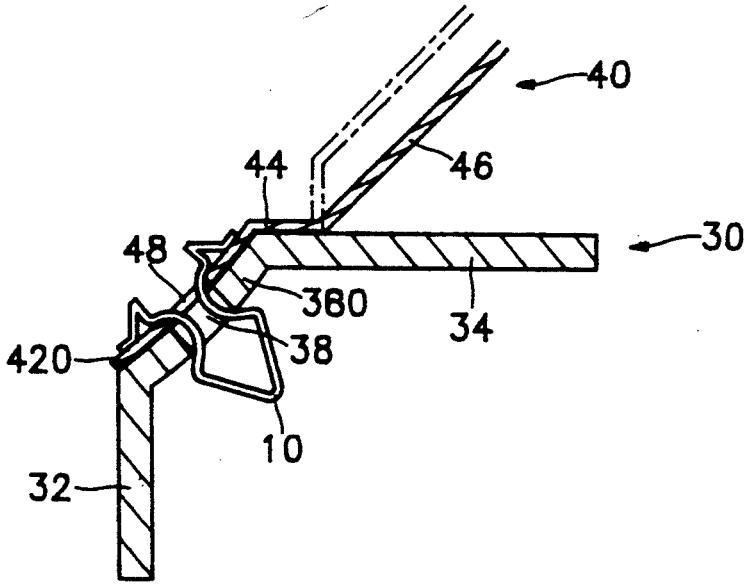
FIG. 2 depicts a schematic view showing a partial section of an assembly in accordance with a second preferred embodiment of this invention.
Figure 3:
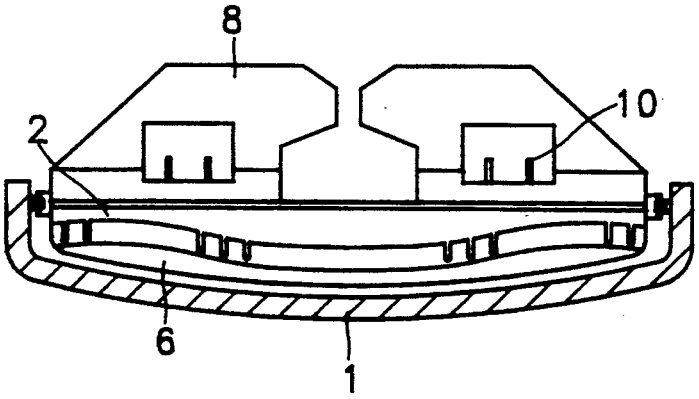
FIG.3 (Prior Art)
FIG. 3 depicts a schematic view showing the internal structure of a face panel for a color picture tube.
Figure 4:
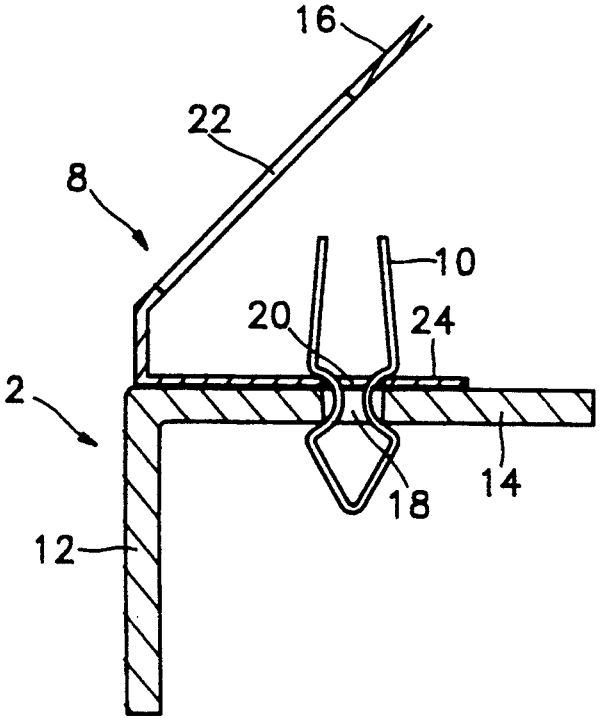
FIG.4 (Prior Art)
FIG. 4 depicts a schematic sectional view of an assembly of a shadow mask frame with an inner shield in a conventional color picture tube.

FIGS. 1 and 2 depict schematic views showing partial sections of each assembly in accordance with preferred embodiments of this invention.

Referring to FIG. 1, a shadow mask frame 30 comprises a rim part 32, a sloping face 36 and a flange part 34. On the sloping face 36 having a predetermined width, a slot 38 to which a clip 10 is inserted is formed.

An angle between the rim part 32 and the flange part 34 is determined by an angle $\theta_2$ between the rim part 32 and the sloping face 36 and an angle $\theta_1$ between the sloping face 36 and the flange part 34. Preferably, the angle between the rim part 32 and the flange part 34 is around 100 degrees. When it comes to determining this angle, the angle is preferably within the range of from 90 to 120 degrees in consideration of the frame's form and deformability by heat.

In the first preferred embodiment of this invention, each angle $\theta_1$ and $\theta_2$ is in the range of 115 to 165 degrees. If the angle $\theta_1$ is 115 degrees and the angle $\theta_2$ is 165 degrees, the angle between the rim part 32 and the flange part 34 is 100 degrees. And even if the angle $\theta_1$ is 165 degrees and the angle $\theta_2$ is 115 degrees, the angle between the rim part 32 and the flange part 34 becomes 100 degrees.

Reference numeral 40 designates an inner shield. This inner shield 40 includes a fixing part 42, a flat part 44 and a shield part 46. The shield part 46 does not have an opening differently from the conventional technique.

The width of the sloping face 38 of the frame 30 is the same as that of the fixing part 42, substantially.

The flat part 44 extends from the inside edge of the fixing part 42. The angle between the flat part 44 and the fixing part 42 equals to the angle $\theta_1$ between the sloping face 36 and the flange part 34.

The shield part 46 extends from the inside edge of the flat part 44. This shield part 46 is bent at a predetermined angle from the flange part 34 of the frame 30.

As shown in the drawings, when the frame 30 is coupled with the inner shield 40, the partial outer edges of the sloping face 36 and the flange part 34 of the frame 30 overlap respectively, and the fixing part 42 and the flat part 44 of the inner shield 40. At this time, a slot 48 is formed at a position corresponding to the slots 38 on the fixing part 42. The clip 10 is inserted into the slots 38, 48 to couple the frame 30 with the inner shield 40.

As can be seen from the comparison between FIG. i to FIG. 2, such a clip having a different technique is used for coupling the frame with the inner shield in this invention.

The clip 10 appearing in FIGS. 1 and 2 has the same configuration as that of the clip which is disclosed in U.S. Patent application Ser. No. 07/632,968 filed by the present applicant on Dec. 24, 1992, ABN, refiled as Ser. No. 07/798,874 now U.S. Pat. No. 5,241,727. The projected portion of this clip formed over the fixing part 42 of the inner shield 40 is not very high and exists in the area defined by the extending face of the fixing part 42 and the rim part 32 and the extending face of the flange part 34, and is not an obstacle to assembling to the frame 30 in a face panel.

In a second preferred embodiment shown in FIG. 2, a sloping face 360 of a frame 30 and a fixing part 420 of an inner shield 40 are formed in a curved manner, which differs from the first preferred embodiment. Each radius of curvature of the sloping face 360 and the fixing part 420 should have a size enough to overlap each other. The sloping face 360 and the fixing part 420 are formed in a curved manner so that they can have the same function as a rib. Accordingly, the strength against the deformation of the frame 30 and the inner shield 40 can be improved.

Parts designated by the dot-dash lines in FIGS, 1 and 2 show that a shield part 46 can be bent at a right angle to the flange part 34 on the inside edge of a flat part 44 to extend to a predetermined height, and is bent again parallel to the primary solid line part with an acute angle.

The advantage of this invention mentioned above is the workability of the clip for coupling the inner shield with the frame by inserting the clip for coupling the shadow mask frame with the inner shield into the slots from the outward of the inner shield. Besides, the inner shield of this invention does not have an opening whereby shielding the influence of the geomagnetic field can be improved.

It is understood that the above description is for the purpose of describing the variour embodiments of the invention, and those skilled in the pertinent art will recognize that various modifications and changes can be made without departing from the scope of the invention, which scope is to be determined by the following claims and the equivalents to which the elements thereof are entitled.

What is claimed is:

1. An assembly of a shadow mask frame with an inner shield for a color cathode ray tube having a shadow mask frame, an inner shield and a clip for coupling said shadow mask frame with said inner shield, said frame having a rim part and flange part bent at a nearly right angle to the rim part and extending inwardly, wherein: a sloping face is formed to a predetermined width between the rim part and the flange part of the frame with a predetermined obtuse angle therebetween, and said inner shield includes a fixing part aligned with said sloping face and having the same width as that of said sloping face, a flat part bent at the same angle as the angle between said sloping face and said flange part, and a shield part extending to a predetermined length from the inside edge of said flat part and bent at a predetermined angle with respect to the flange part of said frame, and each slot is formed on the positions of the sloping face of the frame and the fixing part of the inner shield corresponding to each other when said sloping face is aligned with said fixing part, and said clip is inserted into said slots to couple said frame with said inner shield.

2. The assembly as set forth in claim 1, wherein the angle $\theta_2$ between said rim part and sloping face and the angle $\theta_1$ between said sloping face and flange part is within the range of 115 to 165 degrees, and the angle between said rim part and flange part determined by each angle $\theta_1$ and $\theta_2$ is within the range of 90 to 120 degrees.

3. The assembly as set forth in claim 1, wherein a projected portion of said clip formed over the fixing part of said inner shield exists in the area defined by an extending face of said rim part and an extending face of said flange part.

4. The assembly as set forth in claim 1, wherein said shield part is extending and bent at a right angle to said flange part on the inside edge of the flat part to extend to a predetermined height, and is bent again with a predetermined acute angle with respect to said flange part.

* * * * *